US011747088B2

(12) United States Patent
Gadalla et al.

(10) Patent No.: US 11,747,088 B2
(45) Date of Patent: Sep. 5, 2023

(54) COMPACT HEAT EXCHANGER WITH ALTERNATING FLUID CHANNELS

(71) Applicant: CompRex, LLC, De Pere, WI (US)

(72) Inventors: Hani Ahmed Gadalla, Madison, WI (US); Zhijun Jia, La Crosse, WI (US); Thomas Justin Parlow, West Salem, WI (US)

(73) Assignee: CompRex, LLC, De Pere, WI (US)

( * ) Notice: Subject to any disclaimer, the term of this patent is extended or adjusted under 35 U.S.C. 154(b) by 459 days.

(21) Appl. No.: 16/766,168

(22) PCT Filed: Nov. 21, 2018

(86) PCT No.: PCT/US2018/062355
§ 371 (c)(1),
(2) Date: May 21, 2020

(87) PCT Pub. No.: WO2019/104246
PCT Pub. Date: May 31, 2019

(65) Prior Publication Data

US 2020/0284521 A1 Sep. 10, 2020

Related U.S. Application Data

(60) Provisional application No. 62/589,191, filed on Nov. 21, 2017.

(51) Int. Cl.
*F28D 9/02* (2006.01)
*F28D 9/00* (2006.01)
(Continued)

(52) U.S. Cl.
CPC ..... *F28D 9/0068* (2013.01); *F28D 9/005* (2013.01); *F28F 3/048* (2013.01); *F28F 3/08* (2013.01);
(Continued)

(58) Field of Classification Search
CPC .. F28F 9/22; F28F 3/06; F28F 2260/02; F28F 9/0268; F28F 3/048; F28F 3/08;
(Continued)

(56) References Cited

U.S. PATENT DOCUMENTS 4,256,178 A 3/1981 Fauvel
5,287,918 A 2/1994 Banks et al.
(Continued)

OTHER PUBLICATIONS

International Search Report PCT/US18/62355, dated Feb. 11, 2019.
(Continued)

*Primary Examiner* — Harry E Arant
(74) *Attorney, Agent, or Firm* — Law Office of John K. Pike, PLLC

(57) ABSTRACT

A compact heat exchanger is provided, in which multiple streams can flow within the same layer or layers, and different fluids may flow in alternating channels within the same layer as well as flowing in alternating layers. Having fluids in alternating channels—as compared to only alternating layers within the same layer—increases the direct surface area between the fluids (the primary surface area) for heat transfer, thereby increasing the rate and efficiency of heat transfer. Methods of making and using the heat exchanger are also provided.

41 Claims, 10 Drawing Sheets

(51) Int. Cl.
*F28F 3/04* (2006.01)
*F28F 3/08* (2006.01)
*F28F 9/02* (2006.01)

(52) U.S. Cl.
CPC ..... *F28F 9/0268* (2013.01); *F28F 2260/02* (2013.01)

(58) Field of Classification Search
CPC .. F28F 3/04; F28D 9/0037; F28D 9/02; F28D 9/0075; F28D 9/00; F28D 9/0068; F28D 9/005; F28D 9/0056; F28D 9/0081; F28D 9/0087; F28D 9/0006
See application file for complete search history.

(56) References Cited

U.S. PATENT DOCUMENTS 5,725,051 A 3/1998 Veltkamp
2000/2018526 12/2002 Dobbs et al.
2003/0152488 A1 8/2003 Tonkovich et al.
2009/0314480 A1* 12/2009 Grinbergs ..... H01M 8/04007 429/410
2010/0314088 A1 12/2010 Yoo et al.

OTHER PUBLICATIONS

Written Opinion PCT/US18/62355, dated Feb. 11, 2019.
David C. Denkenberger, Michael J. Brandemuehl, Joshua M. Pearce, and John Zhai, "Expanded microchannel heat exchanger: design, fabrication and preliminary experimental test". Proceedings of the Institution of Mechanical Engineers—Part A: Journal of Power and Energy, 226, 532-544 (2012).
Carlson, M., Keicher, D., "Heat Exchangers & Additive Manufacturing", EWI Additive Manufacturing Consortium (AMC) Fall Meeting, Oct. 29, 2015, Santa Fe, New Mexico.

* cited by examiner

COMPACT HEAT EXCHANGER WITH ALTERNATING FLUID CHANNELS

CROSS-REFERENCE TO RELATED APPLICATIONS

This application claims the benefit of U.S. Application No. 62/589,191, filed Nov. 21, 2017, the entire contents of which are hereby incorporated by reference.

ACKNOWLEDGMENT OF GOVERNMENT SUPPORT

This invention was made with Government support under Grant No. DE-SC0017895, awarded by the Department of Energy SBIR Program. The government has certain rights in the invention.

FIELD OF THE INVENTION

The invention pertains to the field of heat exchangers. More particularly, the invention pertains to compact heat exchangers manufactured through photochemical etching and diffusion bonding (printed circuit heat exchangers) or other additive manufacturing methods.

BACKGROUND OF THE INVENTION

Heat exchangers are commonly used in industry, marine, residential, and other settings to transfer heat from one or more fluids to other fluids without mixing the different fluids. Compact heat exchangers are high surface area heat exchangers used for more effective and efficient heat transfer for more difficult applications, such as tight temperature differences between/among the fluids.

Printed Circuit Heat Exchangers (PCHE) are compact heat exchangers that are manufactured by building in grooves into individual sheets (for example, via photochemical etching and/or laser cutting) and stacking and assembling the sheets to manufacture the exchanger (for example, by bolting, welding, brazed, diffusion bonding). The grooves act as channels for the fluid streams to flow in close proximity and with high surface area to facilitate heat transfer among the fluid streams. Conventional PCHEs distribute each fluid stream into multiple layers where hot and cold streams flow in alternated layers. Layers are manufactured from single sheets of metal, for example with half etching to create separation between the fluids, or from multiple fully etched sheets for each layer with at least a single metal sheet separating adjacent layers. Having multiple sheets provides more manufacturing flexibility, including internal details that improves heat transfer.

Compact heat exchangers provide a large surface area-to-volume ratio to increase the heat transfer among the fluids flowing through the exchanger. Printed Circuit Heat Exchangers are manufactured by etching sheets of metal to produce individual channels through which the fluids flow. Because each sheet is etched using photochemical etching, any flow pattern can be imposed within each layers of the heat exchanger. Most PCHE exchangers use partial etching, that is, the channels are grooves in the metal sheets that do not go all the way through the sheet, producing half-moon channels. The sheets are then stacked and diffusion bonded. Each sheet is a layer through which the fluid flows. Alternating the layers between a hot fluid and a cold fluid allows heat to transfer through the metal separating them.

Another PCHE design uses fully or fully/partially etched sheets. Multiple sheets can be stacked to result in higher height layers through which the fluids flow. Again, the sheets are stacked and diffusion bonded to produce a strong structure for heat exchange. As in the partially etched PCHE design, each layer contains a single fluid and heat is transferred through the walls separating the alternating the layers of hot and cold fluids.

Both partially etched and fully/partially etched layers consist of (1) an inlet header through which the fluid enter and exit the exchangers, (2) an inlet distributor region where the fluid travel from the headers to the main channels, (3) the main exchanger channels where heat is effectively transferred between the fluids, (4) an outlet distributor region where the fluid transitions from the main channels to the exiting headers and finally, (5) an exit header that leads the fluid out of the exchanger. Each fluid stream has at least one of the above five features.

The current invention improves upon PCHE manufacturing to allow multiple streams to flow within the same layer or layers. The inventors have found that this allows different fluids to flow in alternating channels within the same layer as well as flowing in alternating layers. Having fluids in alternating channels—as compared to only alternating layers within the same layer—increases the direct surface area between the fluids (the primary surface area) for heat transfer, thereby increasing the rate and efficiency of heat transfer.

BRIEF DESCRIPTION OF THE SEVERAL EMBODIMENTS

Figure 1:
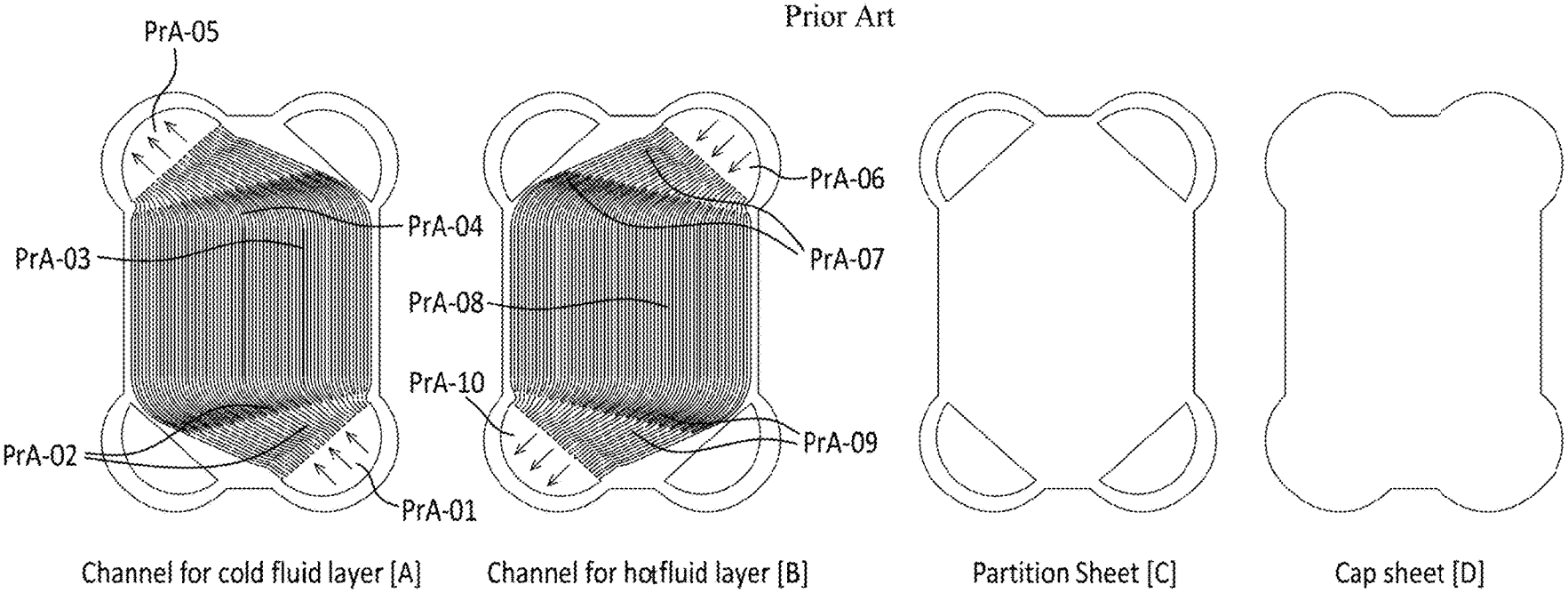
Figure 1 Prior Art
FIG. 1 shows an example of prior art PCHE sheets.

One embodiment provides a heat exchanger, comprising:

a plurality of sheets arranged stackwise in the following order:

(E) a first cold splitter sheet (100) having a common channel distributor section (120) comprising a plurality of common channels (125) in fluid communication with a first cold header (50), a split channel distributor section (130) comprising a plurality of split channels (135) in fluid communication with the common channels (125), and a main exchanger channel section (140) comprising alternating cold and hot exchanger channels (145-C and 145-H, respectively), the cold exchanger channels (145-C) in fluid communication with the split channels (135), the hot exchanger channels (145-H) not in fluid communication with the split channels (135) and not in fluid communication with the cold exchanger channels (145-C) ;

(F) a cold distributor sheet (200) having a common channel distributor section (220) and a parting section (250), the distributor section (220) having a plurality of common channels (225) in fluid communication with both the first cold header (50) and the common channels (125) of the cold splitter sheet (100);

(G) a second cold splitter sheet (300) having a common channel distributor section (320) comprising a plurality of common channels (325) in fluid communication with both the first cold header (50) and the common channels (225) of the cold distributor sheet (200), a split channel distributor section (330) comprising a plurality of split channels (335) in fluid communication with the common channels (325), and a main exchanger channel section (340) comprising alternating cold and hot exchanger channels (345-C and 345-H, respectively), the cold exchanger channels (345-C) in fluid communication with the split channels (335), the hot exchanger channels (345-H) not in fluid communication with split channels (335) and not in fluid communication with cold exchanger channels (345-C);

(H) a first main exchanger sheet (400) having a main exchanger channel section (440) and a main exchanger parting section (450), the channel section (440) having a plurality of alternating hot and cold channels (445-H and 445-C, respectively), the cold channels (445-C) in fluid communication with the cold exchanger channels (345-C) of the second cold splitter sheet (300), the hot channels (445-H) not in fluid communication with the cold channels (445-C);

(I) a first hot splitter sheet (500) having a common channel distributor section (520) comprising a plurality of common channels (525) in fluid communication with a first hot header (60), a split channel distributor section (530) comprising a plurality of split channels (535) in fluid communication with the common channels (525), and a main exchanger channel section (540) comprising alternating cold and hot exchanger channels (545-C and 545-H, respectively), the hot exchanger channels (545-H) in fluid communication with both the split channels (535) and the main exchanger hot channels (445-H) of the first main exchanger sheet (400), the hot exchanger channels (545-H) not in communication with the cold exchanger channels (545-C);

(J) a hot distributor sheet (600) having a common channel distributor section (620) and a parting section (650), the distributor section (620) having a plurality of common channels (625) in fluid communication with both the first hot header (60) and the common channels (525) of the first hot splitter sheet (500);

(K) a second hot splitter sheet (700) having a common channel distributor section (720) comprising a plurality of common channels (725) in fluid communication with both the first hot header (60) and the common channels (625) of the hot distributor sheet (600), a split channel distributor section (730) comprising a plurality of split channels (735) in fluid communication with the common channels (725), and a main exchanger channel section (740) comprising alternating cold and hot exchanger channels (745-C and 745-H, respectively), the hot exchanger channels (745-H) in fluid communication with the split channels (735), the cold exchanger channels (745-C) not in fluid communication with the split channels (735) and not in fluid communication with the hot exchanger channels (745-H); and (L) a second main exchanger sheet (800) having a main exchanger channel section (840) and a main exchanger parting section (850), the channel section (840) having a plurality of alternating hot and cold channels (845-H and 845-C, respectively), the hot channels (845-H) in fluid communication with the hot exchanger channels (745-H) of the second hot splitter sheet (700), the cold channels (845-C) not in fluid communication with the hot channels (845-H).

Another embodiment provides a method for making the heat exchanger, comprising preparing the sheets of claim 1 by printed circuit method, and bonding the sheets together, to produce the heat exchanger.

Another embodiment provides a method, comprising exchanging heat between two fluids in the heat exchanger.

Another embodiment provides a method, comprising carrying out a chemical reaction in the heat exchanger.

DETAILED DESCRIPTION OF THE SEVERAL EMBODIMENTS

A new compact heat exchanger using printed circuit heat exchanger design or other additive heat exchanger methods allows fluids to flow in alternating channels (as opposed to the conventional exchanger where fluids flow in channels in alternating layers). By having hot and cold fluids flow in alternating channels instead of alternating layers, all or most of the secondary heat transfer area becomes primary area, increasing the overall efficiency of heat transfer. The increased efficiency results in smaller heat exchangers, which are potentially lighter and less expensive. Furthermore, by converting the surface area from secondary surface area to primary, higher height channels can be used without cost to heat transfer efficiency. This design flexibility can also result in higher heat transfer efficiency while easing the pressure drop of the fluids as they travel through the exchanger.

The new invention takes advantage of fully etching and multiple sheet layers. In the distributor section (near the main channels), the channels are shifted by a half-layer, allowing the channels in the distributor to flow from the distributor layer to the two adjacent main layers. The distributor channels of one fluid alternate flow into the main layer channels, one to the right and one to the left. The distributor channels of the other stream lead to flow into the other channels in the main exchanger. This half-layer shift of the distributors and the alternating distribution of flow into the main exchanger channels result in the main body of the exchanger having alternating channels between the hot and cold fluids (as compared to the conventional alternating layers). As a result, all or most of the metal that comprises the secondary surface area becomes primary surface area with a 100% heat transfer efficiency (by definition).

The heat transfer area of PCHE is made up of primary surface area (where heat flows directly from the hot fluid, through the metal to the cold fluid) and secondary surface area (the metal surface area where heat is transferred to the primary surface area on the cold side or from the primary surface area on the hot side). Heat transfer through the secondary surface area is less efficient than through the primary surface area, and any increase of the percent of primary surface area increases the overall heat transfer efficiency of the exchanger. Larger channels result in lower pressure drop of the fluid as it travels through the exchanger but increases the amount of secondary surface area (and hence potentially adds heat transfer inefficiency). Design engineers must choose channel dimensions that balance the pressure drop requirements against the heat transfer efficiency. Secondary heat transfer efficiency is measured as a percent of the heat transfer if the surface was primary. Thus converting secondary surface area to primary surface area maximizes the heat transfer efficiency to 100% (by definition).

BRIEF DESCRIPTION OF THE DRAWINGS

The figures show example etched sheets for PCHEs for cold stream (white), hot stream (grey) and parting sheets (black). Here, a parting sheet or parting section is that section or sheet that does not permit flow in or through that part of the sheet. The sections of the exchanger are labeled (headers, distributors and main exchangers), arrows to show general direction of flow, and parting sheet needed for the fully etched exchanger.

Figure 3:
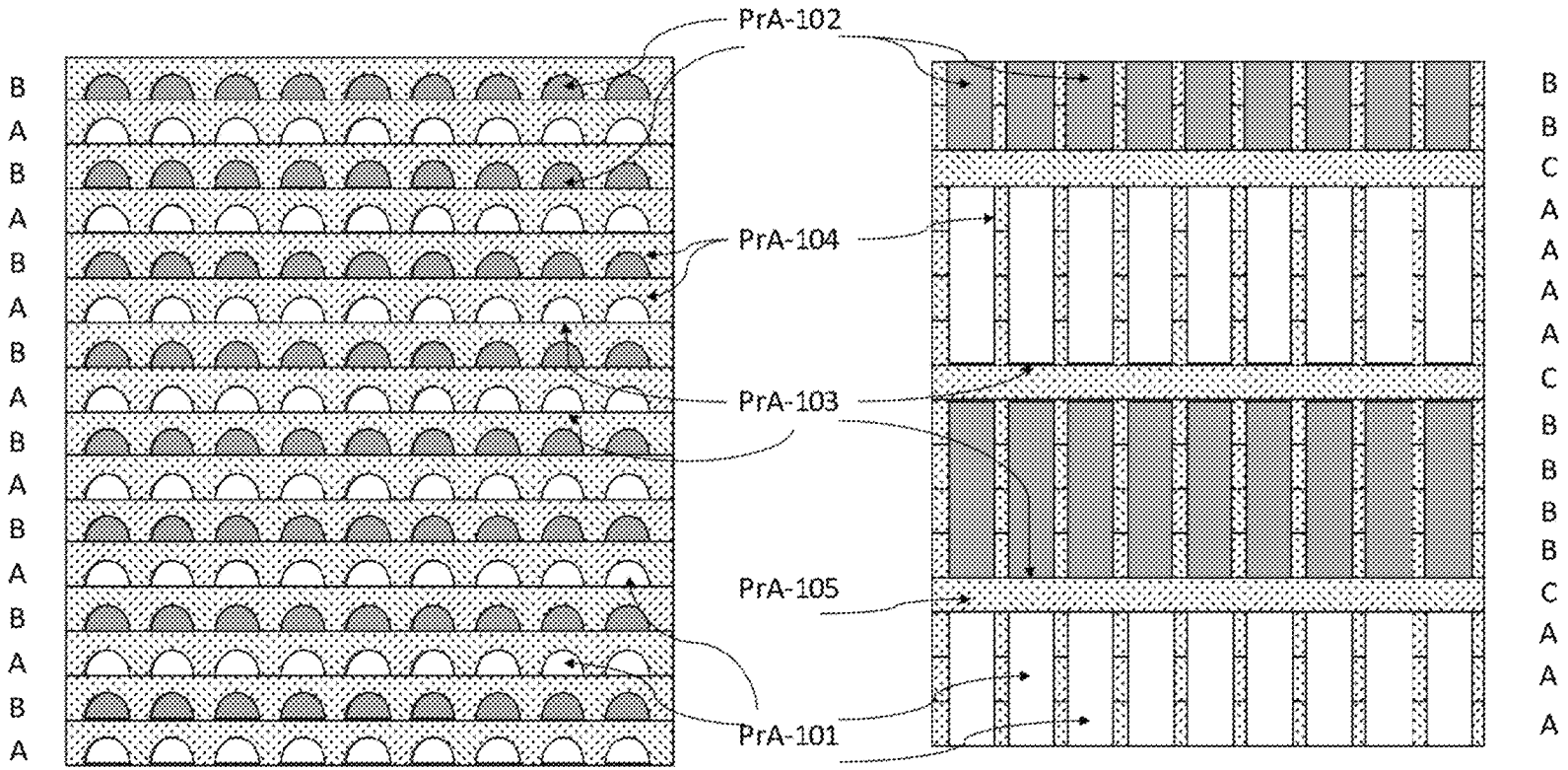
Figure 3 Prior Art
FIG. 3 shows an example of a cross section of prior art main exchanger section with stacked sheets.

FIG. 3 shows a partial view of the cross sectional area of the exchanger after sheet stacking. The left image shows the partially etched sheets with single sheet layers (half-moon). The right image shows multiple sheets stacked to create the layers using fully etched sheets. The primary and secondary surface area is labeled and the stacking order is identified, corresponding with the sheet layer labeling in FIG. 1.

Figure 8:
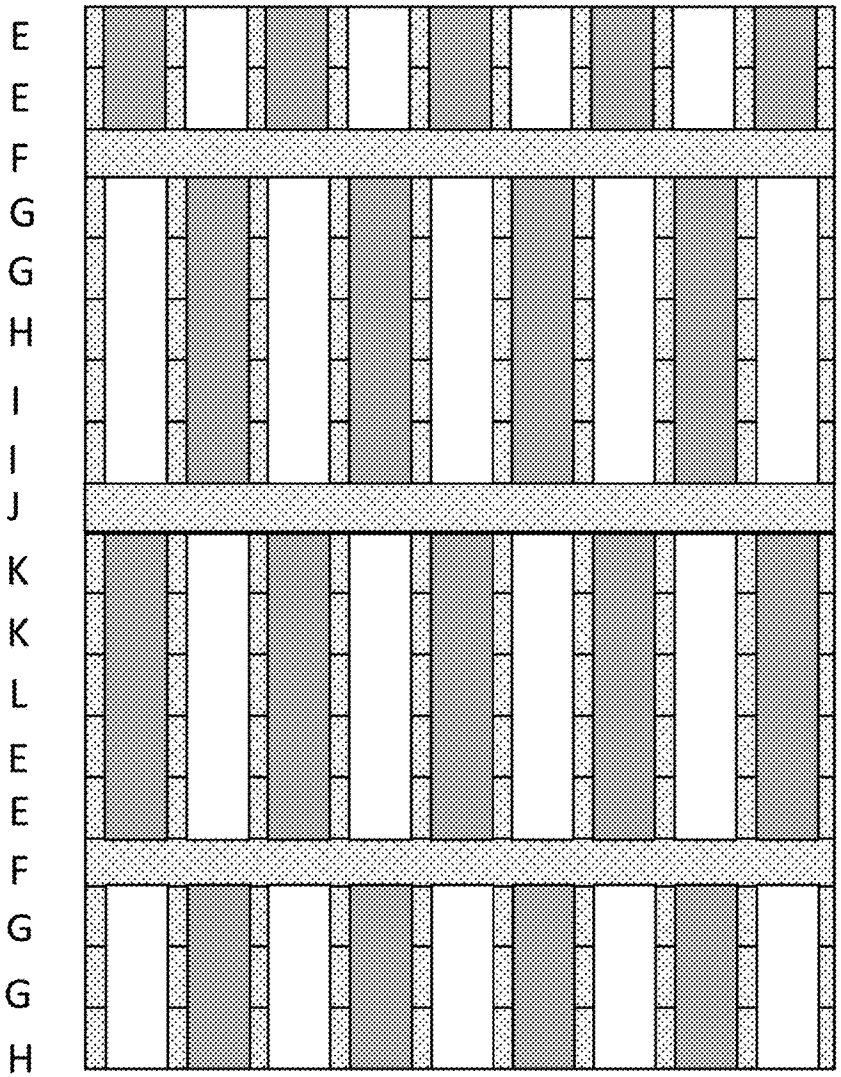
FIG. 8 shows an embodiment of a cross section of main exchanger section with stacked sheets.

FIG. 8 shows the partial view of the cross sectional cut of the main exchanger section for alternating channel exchanger. All secondary surface area found in FIG. 8 is now Primary surface area (with full heat transfer efficiency) in the alternating channel exchanger.

Figure 9:
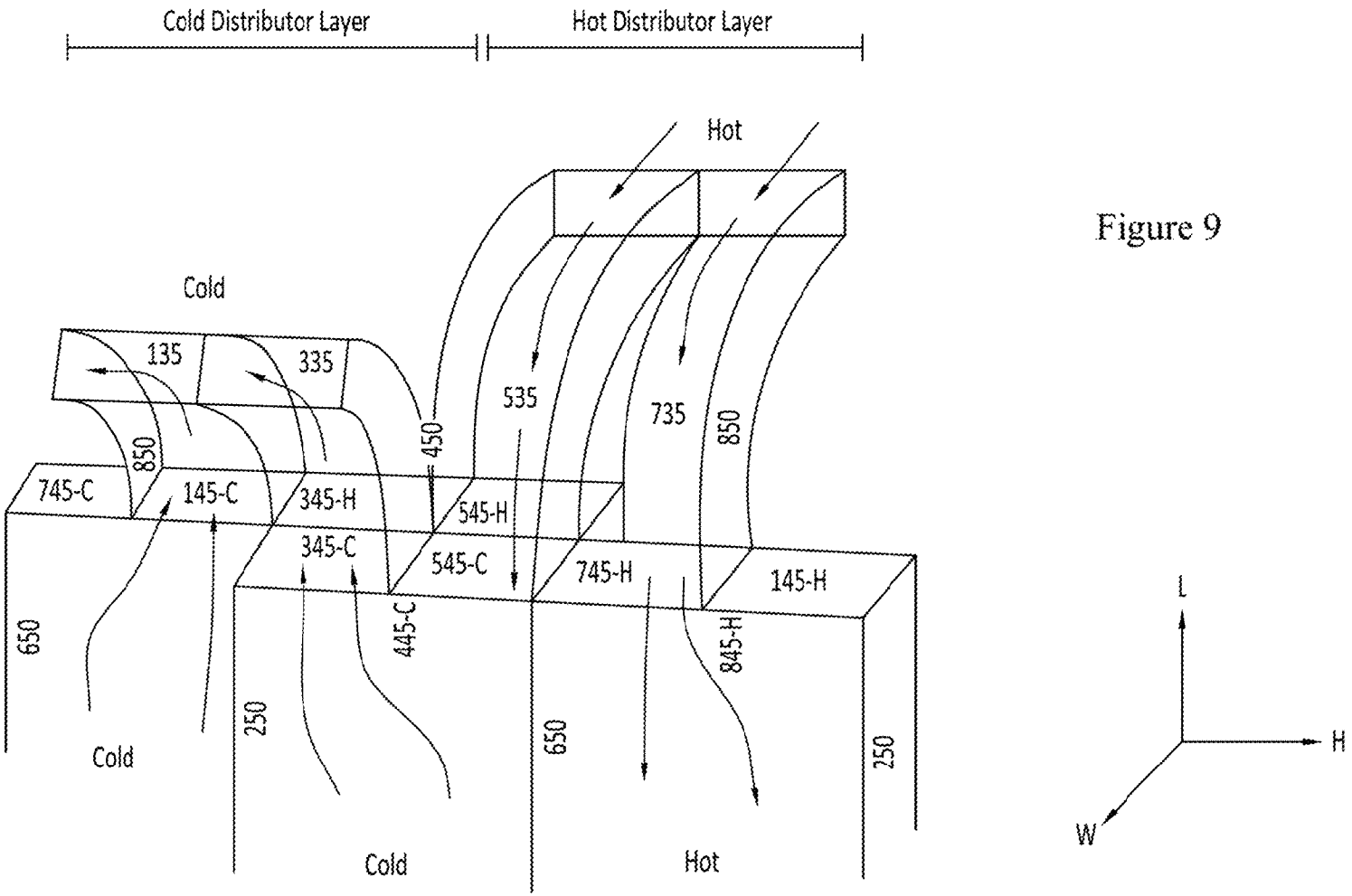
FIG. 9 shows a perspective representation of one embodiment of 3D channel drawing near transition between top distributor and main exchanger channels.

FIG. 9 shows a 3D embodiment of the cold and hot distributor channels as they transition into the main exchanger channels, resulting in the alternating channel exchanger.

FIG. 1 shows an prior art example of the sheets for a PCHE for partially etched or fully etched sheets, showing the cold stream channels in a layer [A], hot stream channels in a layer [B], with arrows to show general fluid flow direction. For the fully etched sheets, a parting sheet [C] is also shown. All sections of the heat exchanger are labeled (headers, distributors and main exchanger section).

FIG. 3 shows a cross sectional cut in the main heat exchanger for prior art partially etched sheets and fully etched sheets. The stacking order, corresponding to FIG. 1, are presented next to the corresponding sheets.

The sheets may be made of any material, preferably metal such as stainless steel, aluminum, titanium, Inconel, hastalloy, high-nickel alloy, Haynes materials, stainless 316, 304, 306, 347, 310, 300 series, 600, 617, 620, 625, aluminum 3000 series, 3003, 4000, 5000, 6000, or combination thereof.

The operating pressure is not particularly limited, and may suitably range from 80-400 bar, preferably 200-350 bar.

The operating temperatures are not particularly limited, and may suitably range from 100-800 C, and preferably 400-750 C.

The terms, "hot" and "cold" are used here for convenience, and may refer to a heating fluid, a cooling fluid, or reactive fluid, or combination thereof as appropriate in the particular header(s) or channel(s). The fluids are not particularly limited and may suitably include supercritical CO2, molten salts, water, helium, argon, nitrogen, oxygen, natural gas, hydrocarbon or petrochemical or other chemical, or any combination thereof.

For example, one or more than one reactive fluid may be introduced into a header inlet, and reacted. Some nonlimiting examples of suitable chemical reactions include natural gas reforming, natural gas coupling, thermal cracking, high temperature oxidation, hydrogenation, and the like, or combination thereof.

For molten salts, examples include $KNO_3$, $NaNO_2$, and $NaNO_3$ with additions of a variety of chlorides (KCl, LiCl, $CaCl_2$, $ZnCl_2$, NaCl and $MgCl_2$, or any combination thereof.

In some embodiments, the hot and cold fluids may be the same.

In an embodiment, the first cold splitter sheet (100) further comprises a second common channel distributor section (180) having a plurality of second common channels (185) in fluid communication with a second cold header (55), and a second split channel distributor section (160) having a plurality of second split channels (165) in fluid communication with the second common channels (185) and the cold exchanger channels (145-C).

In an embodiment, the cold distributor sheet (200) further comprises a second common channel distributor section (280) having a plurality of second common channels (285) in fluid communication with a second cold header (55) and the plurality of second split channels (165) of the first cold splitter sheet (100).

In an embodiment, the second cold splitter sheet (300) further comprises a second common channel distributor section (380) having a plurality of second common channels (385) in fluid communication with a second cold header (55), and a second split channel distributor section (360) having a plurality of second split channels (365) in fluid communication with both the second common channels (385) and the cold exchanger channels (345-C).

In an embodiment, the first hot splitter sheet (500) further comprises a second common channel distributor section (580) having a plurality of second common channels (585) in fluid communication with a second hot header (65), and a second split channel distributor section (560) having a plurality of second split channels (565) in fluid communication with the second common channels (585) and the hot exchanger channels (545-H).

In an embodiment, the hot distributor sheet (600) further comprises a second common channel distributor section (680) having a plurality of second common channels (685) in fluid communication with a second hot header (65) and the plurality of second split channels (565) of the first hot splitter sheet (500).

In an embodiment, the second hot splitter sheet (700) further comprises a second common channel distributor section (780) having a plurality of second common channels (785) in fluid communication with a second hot header (65), and a second split channel distributor section (760) having a plurality of second split channels (765) in fluid communication with both the second common channels (785) and the hot exchanger channels (745-H).

In an embodiment, the hot exchanger channels (445-H) of the first main exchanger sheet (400) are in stackwise registry with both the hot exchanger channels (345-H) of an adjacent cold splitter sheet (300) and the hot exchanger channels (545-H) of an adjacent hot splitter sheet (500).

In an embodiment, the cold exchanger channels (445-C) of the first main exchanger sheet (400) are in stackwise registry with both the cold exchanger channels (345-C) of an adjacent cold splitter sheet (300) and the cold exchanger channels (545-C) of an adjacent hot splitter sheet (500).

10. The heat exchanger of any claim herein, wherein the hot exchanger channels (845-H) of the second main exchanger sheet (800) are in stackwise registry and fluid communication with both the hot exchanger channels (745-H) of an adjacent hot splitter sheet (700) and the hot exchanger channels of an adjacent cold splitter sheet.

In an embodiment, the cold exchanger channels (845-C) of the second main exchanger sheet (800) are in stackwise registry and fluid communication with both the cold exchanger channels (745-C) of an adjacent hot splitter sheet (700) and the cold exchanger channels of an adjacent cold splitter sheet.

In an embodiment, the hot exchanger channels of a splitter sheet on one side of a distributor sheet are in stackwise registry with, but not in fluid communication with, the cold exchanger channels of a splitter sheet on an opposite side of the distributor sheet.

In an embodiment, the hot exchanger channels on one side of a distributor sheet are in stackwise registry with, but not in fluid communication with, the cold exchanger channels of a sheet on an opposite side of the distributor sheet.

In an embodiment, within a single splitter sheet, a cold header inlet is in fluid communication with a cold header outlet.

In an embodiment, within a single splitter sheet, a hot header inlet is in fluid communication with a hot header outlet.

In an embodiment, within a single splitter sheet, a cold header inlet is not in fluid communication with a cold header outlet.

In an embodiment, within a single splitter sheet, a hot header inlet is not in fluid communication with a hot header outlet.

In an embodiment, within a single distributor sheet, a cold header inlet is not in fluid communication with a cold header outlet.

In an embodiment, within a single distributor sheet, a hot header inlet is not in fluid communication with a hot header outlet.

In an embodiment, within a single exchanger sheet, a cold header inlet is not in fluid communication with a cold header outlet.

In an embodiment, within a single exchanger sheet, a hot header inlet is not in fluid communication with a hot header outlet.

In an embodiment, a splitter sheet (1100) further comprises a second common channel distributor section (1180) having a plurality of second common channels (1185) in fluid communication with a second hot header (65), and a second split channel distributor section (1160) having a plurality of second split channels (1165) in fluid communication with the second common channels (1185) and the hot exchanger channels (1145-H).

In an embodiment, a distributor sheet (1200) further comprises a second common channel distributor section (1280) having a plurality of second common channels (1285) in fluid communication with a second hot header (65) and the plurality of second split channels (1165) of the splitter sheet (1100).

In an embodiment, a splitter sheet (1300) further comprises a second common channel distributor section (1380) having a plurality of second common channels (1385) in fluid communication with a second hot header (65), and a second split channel distributor section (1360) having a plurality of second split channels (1365) in fluid communication with both the second common channels (1385) and the hot exchanger channels (1345-H).

In an embodiment, a splitter sheet (1500) further comprises a second common channel distributor section (1580) having a plurality of second common channels (1585) in fluid communication with a second cold header (55), and a second split channel distributor section (1560) having a plurality of second split channels (1565) in fluid communication with the second common channels (1585) and the cold exchanger channels (1545-C).

In an embodiment, a distributor sheet (1600) further comprises a second common channel distributor section (1680) having a plurality of second common channels (1685) in fluid communication with a second cold header (55) and the plurality of second split channels (1565) of the splitter sheet (1500).

In an embodiment, a splitter sheet (1700) further comprises a second common channel distributor section (1780) having a plurality of second common channels (1785) in fluid communication with a second cold header (55), and a second split channel distributor section (1760) having a plurality of second split channels (1765) in fluid communication with both the second common channels (1785) and the cold exchanger channels (1725-C).

In an embodiment, the heat exchanger further comprises capping sheets at each end of the plurality of sheets.

In an embodiment, more than one of any one or more of sheets E, F, G, H, I, J, K, or L are present.

In an embodiment, the common channels in any distribution sheet are in registry with the common channels of the adjacent splitter sheets, so as to be in fluid communication with the common channels of the adjacent splitter sheets.

In an embodiment, the channels in each sheet penetrate or substantially penetrate the entire thickness of the sheet.

In an embodiment, the heat exchanger is produced by 3D printing or an extrusion method.

In an embodiment, the heat exchanger is a printed circuit heat exchanger.

In an embodiment, the sheets are bonded together by diffusion bonding, brazing, or bolting together.

In an embodiment, the sheets are bonded together by diffusion bonding.

In an embodiment, one or more than one of the headers are integral to the sheets, or brazed or welded onto the heat exchanger, or a combination thereof.

In an embodiment, the heat exchanger further comprises one or more reaction channels.

The process of fabricating PCHE is known and typically involves the following steps: (1) etching of flat thin sheets of metal, (2) stacking the sheets of metal in the desired order to produce the array of layers in the proper order, (3) diffusion bonding the stacked sheets under high temperature and applied pressure to produce a single large block of metal that makes up the entirety of the exchanger, (4) welding headers and nozzles through which the fluid will enter and exit the exchanger. If the sheets are partially etched, the bottom part of the sheet is fully intact and therefore prevents fluids from flowing to other layers through the sheet. If the sheets are fully etched or a combination of fully and partially etched, fluids can flow from one sheet to the next. To prevent mixing of the hot and cold fluids, a parting sheet (not etched or only partially etched) is stacked between the sheets of the layers, blocking any flow of fluids. The parting sheet is therefore a complete sheet of metal that prevents flow to penetrate between channels on top and below the parting sheet. Therefore all channels in each layer have a single fluid.

In some embodiments, the channels are fully etched and penetrate the entire thickness of a particular sheet. In some embodiments, the majority of a channel is fully etched, except in spots that are partially etched, to provide ligaments for support during manufacturing an operation, or to obtain dolphin flow.

Figure 4:
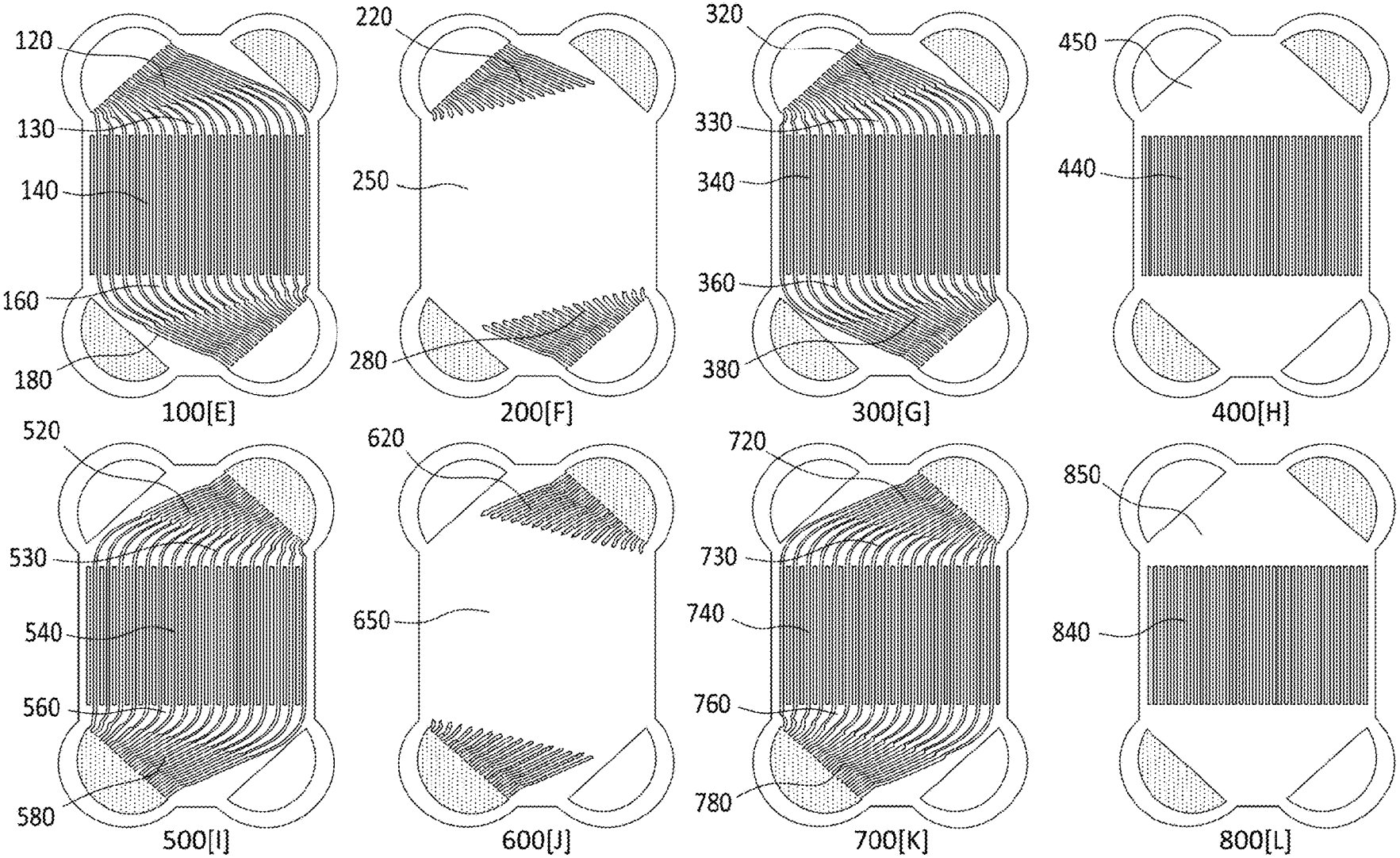
FIG. 4 shows various embodiments of sheets for the alternating channel heat exchanger.
Figure 5:
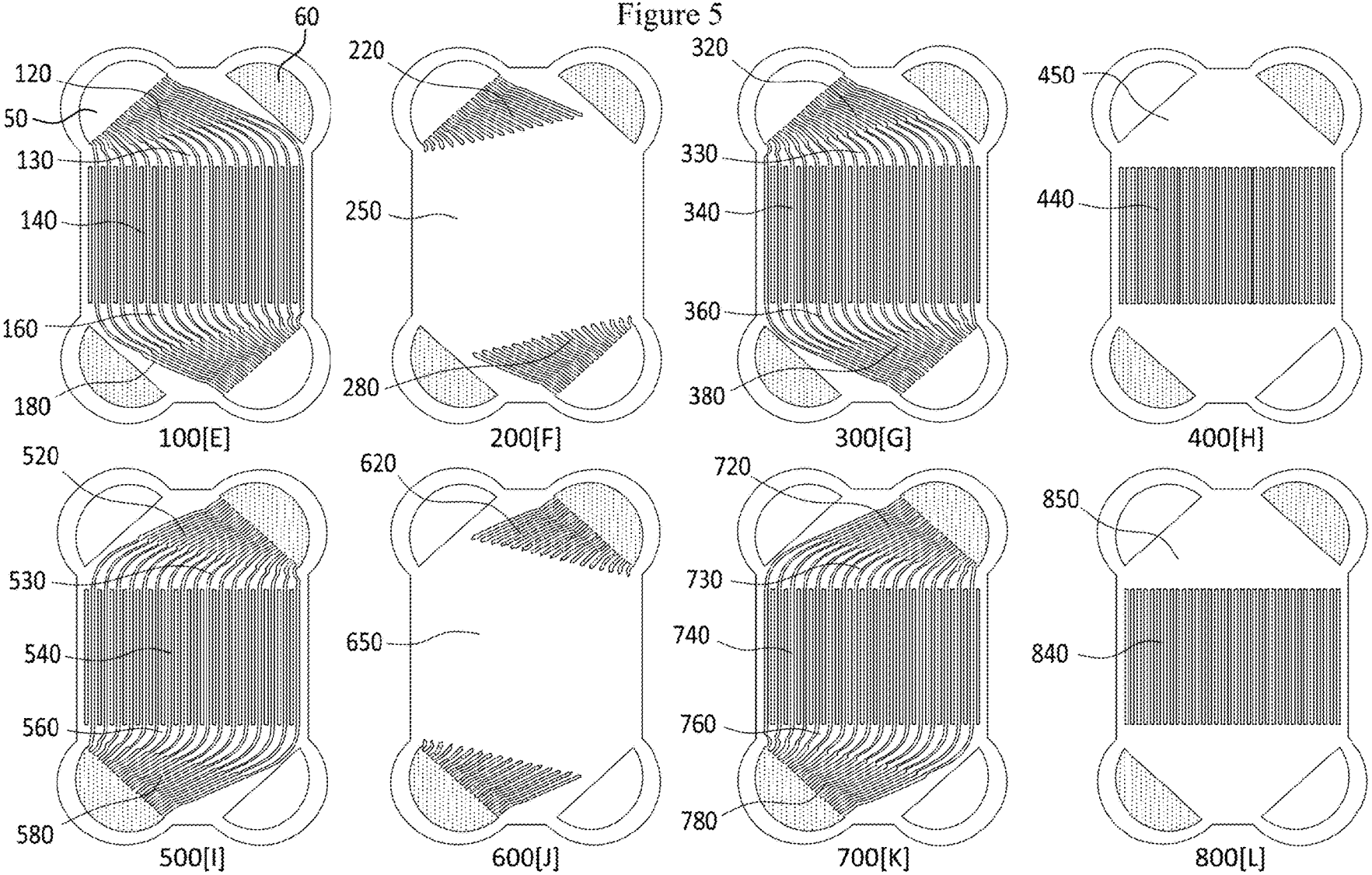
FIG. 5 shows various embodiments of sheets for the alternating channel heat exchanger.
Figure 6:
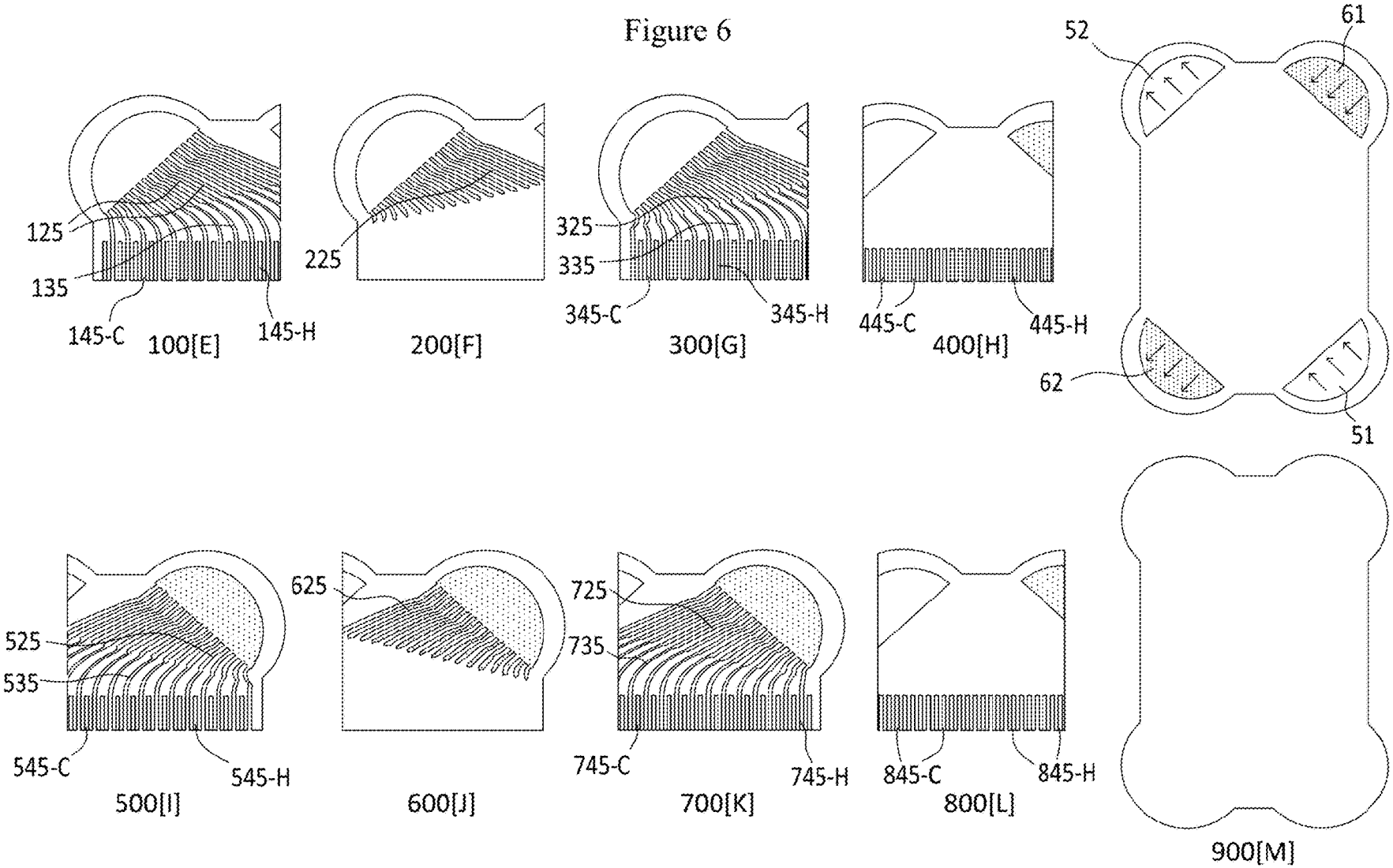
FIG. 6 shows various embodiments of sheets for the alternating channel heat exchanger.
Figure 7:
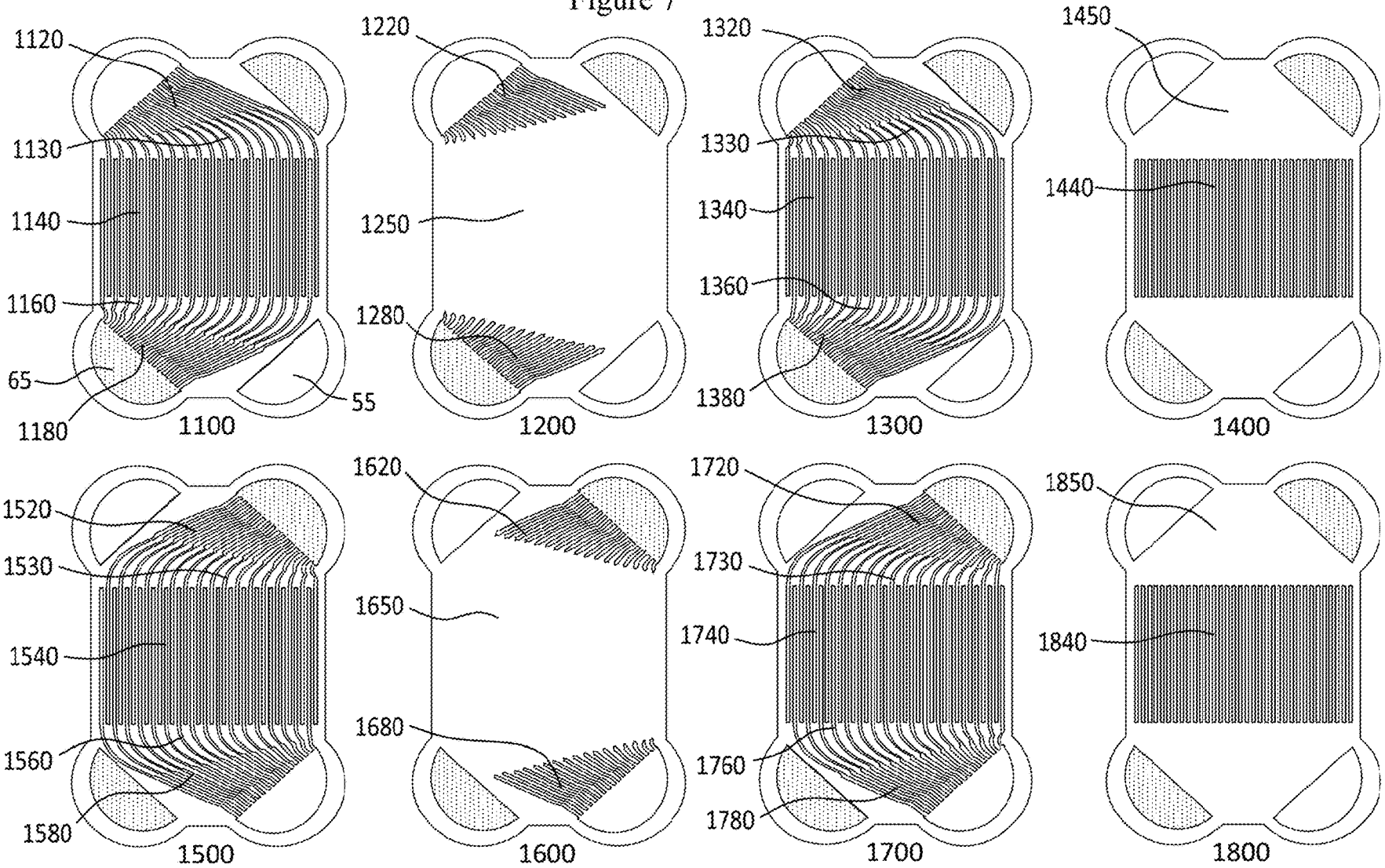
FIG. 7 shows various embodiments of sheets for the alternating channel heat exchanger.

In the new invention, the parting sheet section in the distributor is separated from the parting section in the main exchanger. This results in the distributor layer being shifted over by about 1/2 layer. The parting sheet section in the distributor separates the fluids entering from/exiting to the headers. The channels of each layer in the distributor have a single fluid. As the channels in the distributor approach the channels in the main exchanger, the channels are split and alternated so that every other channel goes to each side of the parting sheet in the main exchanger section (say right and left). The channels of the adjacent distributor layer, through which another fluid flows, similarly are split and alternate to the other channels on the sides of the parting sheet in the main exchanger section (say left and right). In PCHE, the series of etched metal sheets can create the alternating channel flow in the main exchanger channels. FIG. 4 shows an example of the cross section of the stacking these sheets (with repeat sheets to increase the layer height), with sheet labeling presented, corresponding to the sheets in FIG. 3. In the figures, white channels generally correspond to cold stream and grey channels correspond to the hot stream. FIG. 9 shows a 3*d* drawing of the distributor channels as they split to right and left to distribute flow among the layers and channels to produce alternating hot and cold fluid channels.

In one embodiment, channels that are equal in width and height. As a result, all secondary surface area (for the conventional alternating layer design) is converted to primary surface area in the new invention using alternating channel exchanger design. In another embodiment of the invention the two streams may have different heights. This embodiment results in some secondary surface area, but at a minimal and much less than using the alternating layer exchanger design. In yet another embodiment of the invention, the two streams may have different widths. Similarly, this embodiment results in some secondary surface area, much less than using the alternating layer exchanger design. Another embodiment is having channels in each layer having patterns different than a 1-to-1 pattern, such as cold-cold-hot, hot-hot-cold, cold-cold-cold-hot, etc. With each pattern change, secondary surface area is introduced into the design but may be necessary based when significant difference in volumetric flow between streams exists. Another embodiment of the invention can have more than two streams in the exchanger (two hot, one cold; two cold, one hot; three hot, one cold; etc.)

In the figures, exchanger height is measured along the stacking direction, exchanger length is measured along the direction of the main exchanger channels (or more conveniently flow), and width is measured along the direction perpendicular to the main exchanger channels. The terms, "top" and "bottom" refer to the top and bottom of the stack, in the length direction. The terms top and bottom are used for convenience, and unless otherwise specified are not intended to refer to up and down.

Legend

FIG. 1: Example of prior art PCHE sheets

PrA-01: Cold inlet header

PrA-02: Cold inlet distributor section

PrA-03: Main exchanger cold channels

PrA-04: Cold exit distributor section

PrA-05: Cold exit header

PrA-06: Hot inlet header

PrA-07: Hot inlet distributor section

PrA-08: Main exchanger hot channels

PrA-09: Hot exit distributor section

PrA-10: Hot exit header

Figure 2:
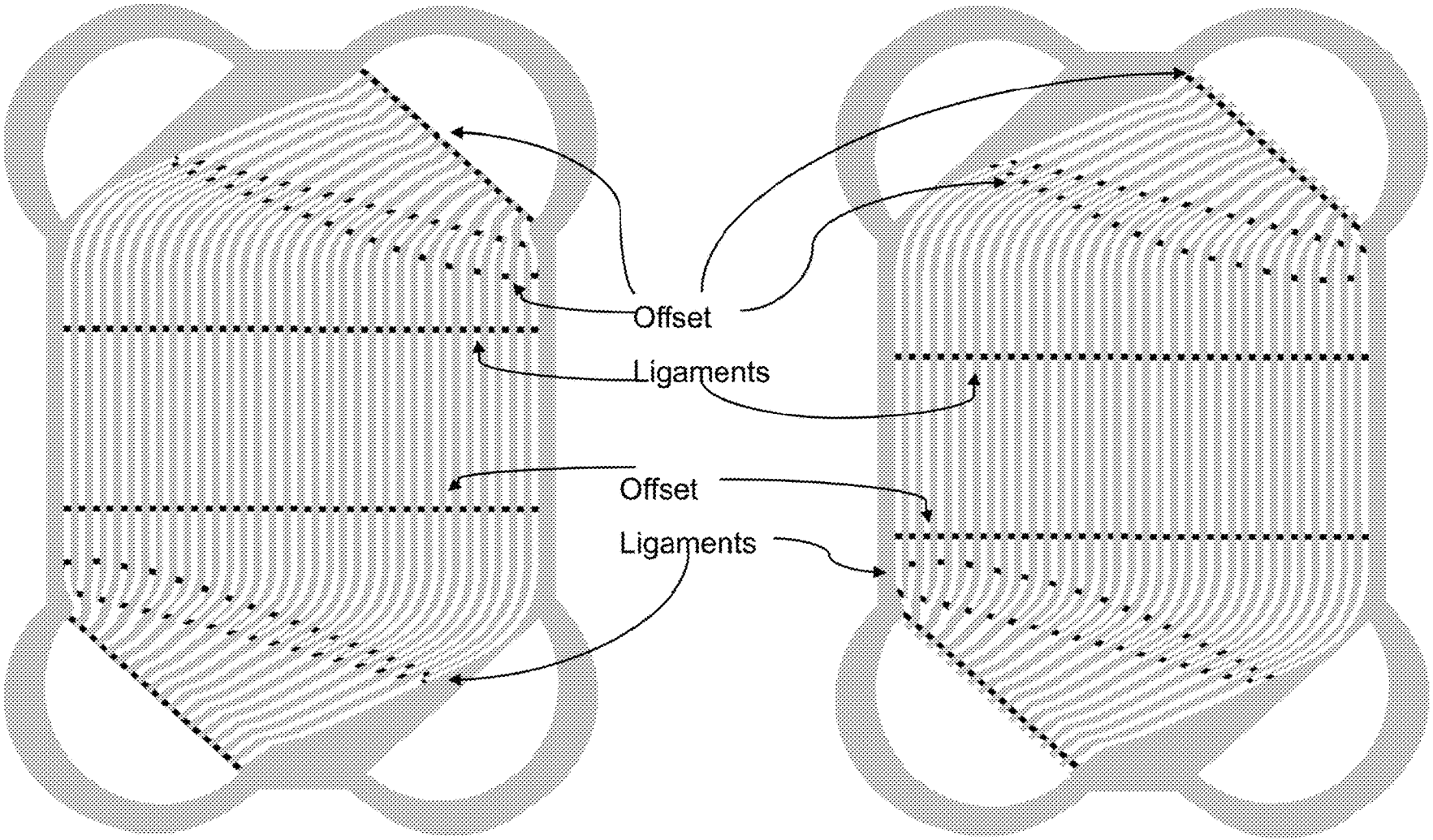
FIG. 2 shows one embodiment of staggered ligaments for manufacturing material support and dolphin flow.

FIG. 2: Embodiment of staggered ligaments for manufacturing material support and dolphin flow FIG. 3: Cross-sectional cut of prior art main exchanger section with stacked sheets PrA-101: Main exchanger cold channels PrA-102: Main exchanger hot channels PrA-103: Primary surface area for heat transfer PrA-104: Secondary surface area for heat transfer PrA-105: Parting sheet separating cold and hot layers FIGS. 4-7: Embodiments of Sheets for the Alternating Channel Heat Exchanger E—Right Cold Splitter Sheet 100 (1100)
- Common Channel Distributor Section 120 (1120)
  - Common Channels 125 (1125)
- Split Channel Distributor Section 130 (1130)
  - Split Channels 135 (1135)
- Main Exchanger Channel Section 140 (1140)
  - Main Exchanger Channels 145 (1145)
    - Cold Splitter Exchanger Channels 145-C (1145-C)
    - Hot Exchanger Channels 145-H (1145-H)
- Split Channel Distributor Section 160 (1160)
  - Split Channels 165 (1165)
- Common Channel Distributor Section 180 (1180)

F—Cold Distributor Sheet 200 (1200)
- Common Channel Distributor Section 220 (1220)
  - Common Channels 225 (1225)
- Cold Distributor Parting Section 250 (1250)
- Common Channel Distributor Section 280 (1280)

G—Left Cold Splitter Sheet 300 (1300)
- Common Channel Distributor Section 320 (1320)
  - Common Channels 325 (1325)
- Split Channel Distributor Section 330 (1330)
  - Split Channels 335 (1335)
- Main Exchanger Channel Section 340 (1340)
  - Main Exchanger Channels 345 (1345)
    - Cold Splitter Exchanger Channels 345-C (1345-C)
    - Hot Exchanger Channels 345-H (1345-H)
- Split Channel Distributor Section 360 (1360)
  - Split Channels 365 (1365)
- Common Channel Distributor Section 380 (1380)

H—Main Exchanger Sheet 400 (1400)
- Main Exchanger Channel Section 440 (1440)
  - Main Exchanger Channels 445 (1445)
    - Main Exchanger Cold Channels 445-C (1445-C)
    - Main Exchanger Hot Channels 445-H (1445-H)
- Main Exchanger Parting Section 450 (1450)

I—Right Hot Splitter Sheet 500 (1500)
- Common Channel Distributor Section 520 (1520)
  - Common Channels 525 (1525)
- Split Channel Distributor Section 530 (1530)
  - Split Channels 535 (1535)
- Main Exchanger Channel Section 540 (1540)
  - Hot Splitter Exchanger Channels 545-H (1545-H)
  - Cold Exchanger Channels 545-C (1545-C)
- Split Channel Distributor Section 560 (1560)
  - Split Channels 565 (1565)
- Common Channel Distributor Section 580 (1580)

J—Hot Distributor Sheet 600 (1600)
- Common Channel Distributor Section 620 (1620)
  - Common Channels 625 (1625)
- Hot Distributor Parting Section 650 (1650)

K—Left Hot Splitter Sheet 700 (1700)
- Common Channel Distributor Section 720 (1720)
  - Common Channels 725 (1725)
- Split Channel Distributor Section 730 (1730)
  - Split Channels 735 (1735)
- Main Exchanger Channel Section 740 (1740)
  - Hot Splitter Exchanger Channels 745-H (1745-H)
  - Cold Exchanger Channels 745-C (1745-C)

Split Channel Distributor Section 760 (1760)
Split Channels 765 (1765)
Common Channel Distributor Section 780 (1780)
L—Main Exchanger Sheet 800 (1800)
Main Exchanger Channel Section 840 (1840)
Main Exchanger Cold Channels 845-C (1845-C)
Main Exchanger Hot Channels 845-H (1845-H)
Main Exchanger Parting Section 850 (850)
M—Cap Sheet 900 (with the caveat that the headers can be welded on, or if etched, filled in)
Cold Header 50 (can be etched, or welded on later)
Cold Header Inlet 51
Cold Header Outlet 52
Hot Header 60
Hot Header Inlet 61
Hot Header Outlet 62
Second cold header 55
Second hot header 65

Figure 10:
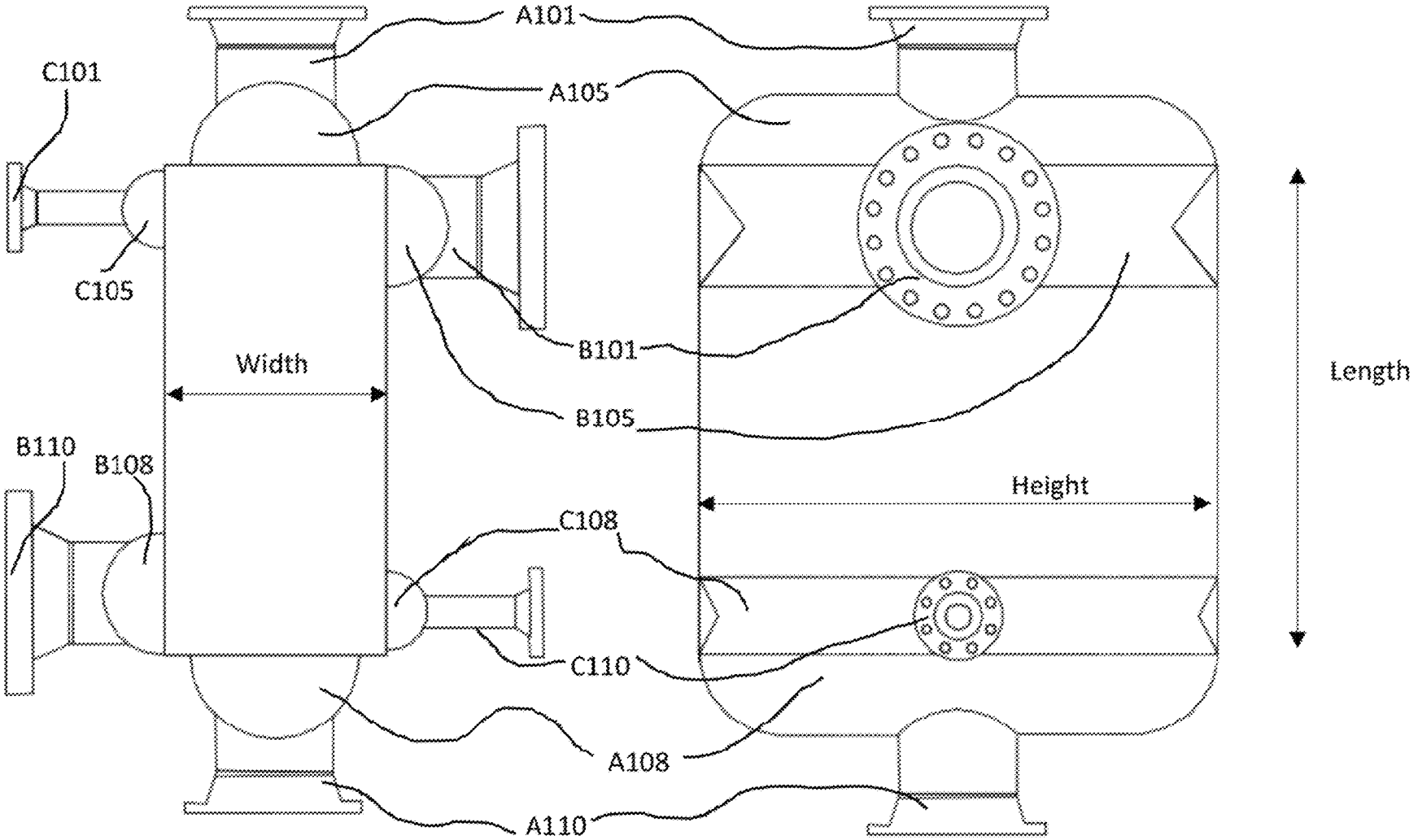
FIG. 10 shows an embodiment of three-stream heat exchanger with headers and nozzles.

FIG. 8: One embodiment of Cross-sectional cut of main exchanger section with stacked sheets FIG. 9: Perspective representation of one embodiment of 3D channel drawing near transition between top distributor and main exchanger channels FIG. 10: One embodiment of three-stream heat exchanger with headers and nozzles A101: Top nozzle for Stream A
A105: Top header for Stream A
A108: Bottom header for Stream A
A110: Bottom nozzle for Stream A
B101: Top nozzle for Stream B
B105: Top header for Stream B
B108: Bottom header for Stream B
B110: Bottom nozzle for Stream B
C101: Top nozzle for Stream C
C105: Top header for Stream C
C108: Bottom header for Stream C
C110: Bottom nozzle for Stream C Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A heat exchanger, comprising:

a plurality of sheets arranged stackwise in the following order:

(E) a first cold splitter sheet (100) having a common channel distributor section (120) comprising a plurality of common channels (125) in fluid communication with a first cold header (50), a split channel distributor section (130) comprising a plurality of split channels (135) in fluid communication with the common channels (125), and a main exchanger channel section (140) comprising alternating cold and hot exchanger channels (145-C and 145-H, respectively), the cold exchanger channels (145-C) in fluid communication with the split channels (135), the hot exchanger channels (145-H) not in fluid communication with the split channels (135) and not in fluid communication with the cold exchanger channels (145-C);

(F) a cold distributor sheet (200) having a common channel distributor section (220) and a parting section (250), the distributor section (220) having a plurality of common channels (225) in fluid communication with both the first cold header (50) and the common channels (125) of the cold splitter sheet (100);

(G) a second cold splitter sheet (300) having a common channel distributor section (320) comprising a plurality of common channels (325) in fluid communication with both the first cold header (50) and the common channels (225) of the cold distributor sheet (200), a split channel distributor section (330) comprising a plurality of split channels (335) in fluid communication with the common channels (325), and a main exchanger channel section (340) comprising alternating cold and hot exchanger channels (345-C and 345-H, respectively), the cold exchanger channels (345-C) in fluid communication with the split channels (335), the hot exchanger channels (345-H) not in fluid communication with split channels (335) and not in fluid communication with cold exchanger channels (345-C);

(H) a first main exchanger sheet (400) having a main exchanger channel section (440) and a main exchanger parting section (450), the channel section (440) having a plurality of alternating hot and cold channels (445-H and 445-C, respectively), the cold channels (445-C) in fluid communication with the cold exchanger channels (345-C) of the second cold splitter sheet (300), the hot channels (445-H) not in fluid communication with the cold channels (445-C);

(I) a first hot splitter sheet (500) having a common channel distributor section (520) comprising a plurality of common channels (525) in fluid communication with a first hot header (60), a split channel distributor section (530) comprising a plurality of split channels (535) in fluid communication with the common channels (525), and a main exchanger channel section (540) comprising alternating cold and hot exchanger channels (545-C and 545-H, respectively), the hot exchanger channels (545-H) in fluid communication with both the split channels (535) and the main exchanger hot channels (445-H) of the first main exchanger sheet (400), the hot exchanger channels (545-H) not in communication with the cold exchanger channels (545-C);

(J) a hot distributor sheet (600) having a common channel distributor section (620) and a parting section (650), the distributor section (620) having a plurality of common channels (625) in fluid communication with both the first hot header (60) and the common channels (525) of the first hot splitter sheet (500);

(K) a second hot splitter sheet (700) having a common channel distributor section (720) comprising a plurality of common channels (725) in fluid communication with both the first hot header (60) and the common channels (625) of the hot distributor sheet (600), a split channel distributor section (730) comprising a plurality of split channels (735) in fluid communication with the common channels (725), and a main exchanger channel section (740) comprising alternating cold and hot exchanger channels (745-C and 745-H, respectively), the hot exchanger channels (745-H) in fluid communication with the split channels (735), the cold exchanger channels (745-C) not in fluid communication with the split channels (735) and not in fluid communication with the hot exchanger channels (745-H); and (L) a second main exchanger sheet (800) having a main exchanger channel section (840) and a main exchanger parting section (850), the channel section (840) having a plurality of alternating hot and cold channels (845-H and 845-C, respectively), the hot channels (845-H) in fluid communication with the hot exchanger channels (745-H) of the second hot splitter sheet (700), the cold channels (845-C) not in fluid communication with the hot channels (845-H).

2. The heat exchanger of claim 1, wherein the first cold splitter sheet (100) further comprises a second common channel distributor section (180) having a plurality of second common channels (185) in fluid communication with a second cold header (55), and a second split channel distributor section (160) having a plurality of second split channels (165) in fluid communication with the second common channels (185) and the cold exchanger channels (145-C).

3. The heat exchanger of claim 1, wherein the cold distributor sheet (200) further comprises a second common channel distributor section (280) having a plurality of second common channels (285) in fluid communication with a second cold header (55) and the plurality of second split channels (265) of the first cold splitter sheet (100).

4. The heat exchanger of claim 1, wherein the second cold splitter sheet (300) further comprises a second common channel distributor section (380) having a plurality of second common channels (385) in fluid communication with a second cold header (55), and a second split channel distributor section (360) having a plurality of second split channels (365) in fluid communication with both the second common channels (385) and the cold exchanger channels (345-C).

5. The heat exchanger of claim 1, wherein the first hot splitter sheet (500) further comprises a second common channel distributor section (580) having a plurality of second common channels (585) in fluid communication with a second hot header (65), and a second split channel distributor section (560) having a plurality of second split channels (565) in fluid communication with the second common channels (585) and the hot exchanger channels (545-H).

6. The heat exchanger of claim 1, wherein the hot distributor sheet (600) further comprises a second common channel distributor section (680) having a plurality of second common channels (685) in fluid communication with a second hot header (65) and the plurality of second common channels (585) of the first hot splitter sheet (500).

7. The heat exchanger of claim 1, wherein the second hot splitter sheet (700) further comprises a second common channel distributor section (780) having a plurality of second common channels (785) in fluid communication with a second hot header (65), and a second split channel distributor section (760) having a plurality of second split channels (765) in fluid communication with both the second common channels (785) and the hot exchanger channels (745-H).

8. The heat exchanger of claim 1, wherein the hot exchanger channels (445-H) of the first main exchanger sheet (400) are in stackwise registry with both the hot exchanger channels (345-H) of an adjacent cold splitter sheet (300) and the hot exchanger channels (545-H) of an adjacent hot splitter sheet (500).

9. The heat exchanger of claim 1, wherein the cold exchanger channels (445-C) of the first main exchanger sheet (400) are in stackwise registry with both the cold exchanger channels (345-C) of an adjacent cold splitter sheet (300) and the cold exchanger channels (545-C) of an adjacent hot splitter sheet (500).

10. The heat exchanger of claim 1, wherein the hot exchanger channels (845-H) of the second main exchanger sheet (800) are in stackwise registry and fluid communication with both the hot exchanger channels (745-H) of an adjacent hot splitter sheet (700) and the hot exchanger channels of an adjacent cold splitter sheet.

11. The heat exchanger of claim 1, wherein the cold exchanger channels (845-C) of the second main exchanger sheet (800) are in stackwise registry and fluid communication with both the cold exchanger channels (745-C) of an adjacent hot splitter sheet (700) and the cold exchanger channels of an adjacent cold splitter sheet.

12. The heat exchanger of claim 1, wherein the hot exchanger channels of a splitter sheet on one side of a distributor sheet are in stackwise registry with, but not in fluid communication with, the cold exchanger channels of a splitter sheet on an opposite side of the distributor sheet.

13. The heat exchanger of claim 1, wherein the hot exchanger channels on one side of a distributor sheet are in stackwise registry with, but not in fluid communication with, the cold exchanger channels of a sheet on an opposite side of the distributor sheet.

14. The heat exchanger of claim 1, wherein within a single splitter sheet, a cold header inlet is in fluid communication with a cold header outlet.

15. The heat exchanger of claim 1, wherein within a single splitter sheet, a hot header inlet is in fluid communication with a hot header outlet.

16. The heat exchanger of claim 1, wherein within a single splitter sheet, a cold header inlet is not in fluid communication with a cold header outlet.

17. The heat exchanger of claim 1, wherein within a single splitter sheet, a hot header inlet is not in fluid communication with a hot header outlet.

18. The heat exchanger of claim 1, wherein within a single distributor sheet, a cold header inlet is not in fluid communication with a cold header outlet.

19. The heat exchanger of claim 1, wherein within a single distributor sheet, a hot header inlet is not in fluid communication with a hot header outlet.

20. The heat exchanger of claim 1, wherein within a single exchanger sheet, a cold header inlet is not in fluid communication with a cold header outlet.

21. The heat exchanger of claim 1, wherein within a single exchanger sheet, a hot header inlet is not in fluid communication with a hot header outlet.

22. The heat exchanger of claim 1, wherein a splitter sheet (1100) further comprises a second common channel distributor section (1180) having a plurality of second common channels (1185) in fluid communication with a second hot header (65), and a second split channel distributor section (1160) having a plurality of second split channels (1165) in fluid communication with the second common channels (1185) and the hot exchanger channels (1145-H).

23. The heat exchanger of claim 1, wherein a distributor sheet (1200) further comprises a second common channel distributor section (1280) having a plurality of second common channels (1285) in fluid communication with a second hot header (65) and the plurality of second common channels (1185) of the splitter sheet (1100).

24. The heat exchanger of claim 1, wherein a splitter sheet (1300) further comprises a second common channel distributor section (1380) having a plurality of second common channels (1385) in fluid communication with a second hot header (65), and a second split channel distributor section (1360) having a plurality of second split channels (1365) in fluid communication with both the second common channels (1385) and the hot exchanger channels (1345-H).

25. The heat exchanger of claim 1, wherein a splitter sheet (1500) further comprises a second common channel distributor section (1580) having a plurality of second common channels (1585) in fluid communication with a second cold header (55), and a second split channel distributor section (1560) having a plurality of second split channels (1565) in fluid communication with the second common channels (1585) and the cold exchanger channels (1545-C).

26. The heat exchanger of claim 1, wherein a distributor sheet (1600) further comprises a second common channel distributor section (1680) having a plurality of second common channels (1685) in fluid communication with a second cold header (55) and the plurality of second common channels (1585) of the splitter sheet (1500).

27. The heat exchanger of claim 1, wherein a splitter sheet (1700) further comprises a second common channel distributor section (1780) having a plurality of second common channels (1785) in fluid communication with a second cold header (55), and a second split channel distributor section (1760) having a plurality of second split channels (1765) in fluid communication with both the second common channels (1785) and the cold exchanger channels (1745-C).

28. The heat exchanger of claim 1, further comprising capping sheets at each end of the plurality of sheets.

29. The heat exchanger of claim 1, wherein more than one of any one or more of sheets E, F, G, H, I, J, K, or L are present.

30. The heat exchanger of claim 1, wherein the common channels in any distribution sheet are in registry with the common channels of the adjacent splitter sheets, so as to be in fluid communication with the common channels of the adjacent splitter sheets.

31. The heat exchanger of claim 1, wherein the channels in each sheet penetrate or substantially penetrate the entire thickness of the sheet.

32. The heat exchanger of claim 1, wherein the heat exchanger is produced by 3D printing or an extrusion method.

33. The heat exchanger of claim 1, wherein the heat exchanger is a printed circuit heat exchanger.

34. The heat exchanger of claim 1, wherein the sheets are bonded together by diffusion bonding, brazing, or bolting together.

35. The heat exchanger of claim 1, wherein the sheets are bonded together by diffusion bonding.

36. The heat exchanger of claim 1, wherein one or more than one of the headers are integral to the sheets, or brazed or welded onto the heat exchanger, or a combination thereof.

37. The heat exchanger of claim 1, further comprising one or more reaction channels.

38. The heat exchanger of claim 1, wherein either or both the distributor sheets (200, 1200) and (600, 1600) are full parting sheets with no channels in the distributor section.

39. A method for making the heat exchanger of claim 1, comprising preparing the sheets of claim 1 by printed circuit method, and bonding the sheets together, to produce the heat exchanger.

40. A method, comprising exchanging heat between two fluids in the heat exchanger of claim 1.

41. A method, comprising carrying out a chemical reaction in the heat exchanger of claim 1.

* * * * *